US010274133B2

(12) United States Patent
Kunkel

(10) Patent No.: US 10,274,133 B2
(45) Date of Patent: Apr. 30, 2019

(54) ALL-IN-ONE SKID ASSEMBLY

(71) Applicant: Thomas Kunkel, Cranberry Township, PA (US)

(72) Inventor: Thomas Kunkel, Cranberry Township, PA (US)

( * ) Notice: Subject to any disclaimer, the term of this patent is extended or adjusted under 35 U.S.C. 154(b) by 12 days.

(21) Appl. No.: 15/626,737

(22) Filed: Jun. 19, 2017

(65) Prior Publication Data

US 2018/0003342 A1 Jan. 4, 2018

Related U.S. Application Data

(60) Provisional application No. 62/356,168, filed on Jun. 29, 2016.

(51) Int. Cl.
*F17C 5/06* (2006.01)
*F17D 1/04* (2006.01)

(52) U.S. Cl.
CPC ..... *F17C 5/06* (2013.01); *F17D 1/04* (2013.01); *F17C 2221/033* (2013.01); *F17C 2223/0123* (2013.01); *F17C 2225/0153* (2013.01); *F17C 2225/035* (2013.01); *F17C 2227/0157* (2013.01); *F17C 2227/0171* (2013.01); *F17C 2250/01* (2013.01); *F17C 2270/01* (2013.01)

(58) Field of Classification Search
CPC ..... F17C 5/00
See application file for complete search history.

(56) References Cited

U.S. PATENT DOCUMENTS 2,328,178 A * 8/1943 Teter ..... C10G 11/18 208/113
3,989,487 A * 11/1976 Peterson ..... B01D 1/00 96/242
4,462,813 A * 7/1984 May ..... C07C 7/09 62/613
5,882,486 A * 3/1999 Moore, Jr. ..... B01D 1/28 202/186
6,820,689 B2 * 11/2004 Sarada ..... E21B 41/0057 166/244.1
6,829,906 B2 * 12/2004 Beam ..... F17C 7/00 62/613
6,936,665 B2 * 8/2005 Stephens ..... B01J 8/10 526/65
6,984,257 B2 * 1/2006 Heath ..... B01D 53/002 95/174

(Continued)

*Primary Examiner* — Matthew R Buck
*Assistant Examiner* — Aaron L Lembo
(74) *Attorney, Agent, or Firm* — Kathleen Kuznicki; The Lynch Law Group, LLC

(57) ABSTRACT

Disclosed is an assembly that is an all-in-one combination of piping and equipment systems designed to provide a compact, simple, pre-fabricated assembly on single skid platform to meet all the functional needs of a petrochemical gas compression facility. The skid platform assembly provides a traveling pathway for the fluid generated from a well and is designed to provide all required pre-compressor and post-compressor functional equipment needs for each individual installed gas compressor. The skid platform assembly comprises an integrated liquid separator that also functions as a common liquid sump for all liquid generated by the pre-compressor and post-compressor functional equipment.

22 Claims, 3 Drawing Sheets

(56) References Cited

U.S. PATENT DOCUMENTS

| | | | | |
|---|---|---|---|---|
| 7,024,796 | B2 * | 4/2006 | Carin | C05F 3/00 34/363 |
| 8,870,991 | B2 * | 10/2014 | Burns | B01D 46/0024 55/410 |
| 9,662,597 | B1 * | 5/2017 | Formoso | B01D 19/0057 |
| 9,719,024 | B2 * | 8/2017 | Young | H04W 76/10 |
| 10,000,704 | B2 * | 6/2018 | Young | H04W 76/10 |
| 2004/0011523 | A1 * | 1/2004 | Sarada | E21B 41/0057 166/244.1 |
| 2006/0054318 | A1 * | 3/2006 | Sarada | E21B 41/0057 166/266 |
| 2008/0017369 | A1 * | 1/2008 | Sarada | E21B 43/40 166/244.1 |
| 2013/0294939 | A1 * | 11/2013 | Gilarranz | F04D 17/12 417/53 |
| 2014/0366577 | A1 * | 12/2014 | Zubrin | H04W 76/10 62/619 |
| 2015/0233634 | A1 * | 8/2015 | Zubrin | F25J 3/0209 62/619 |
| 2015/0368566 | A1 * | 12/2015 | Young | H04W 76/10 700/273 |
| 2017/0292077 | A1 * | 10/2017 | Young | H04W 76/10 |

* cited by examiner

ALL-IN-ONE SKID ASSEMBLY

This non-provisional patent application claims priority to provisional patent application Ser. No. 62/356,168 filed on Jun. 29, 2016, the disclosure of which is fully incorporated into this application.

BACKGROUND

Natural gas gathering compressor facilities built using traditional methods use separate pieces of equipment connected with lengths of pipe which must all be sized for anticipated station growth. The growth plans change often, affected by the dynamic nature of drilling plans, differing well production flows, and unknown longevity/decrease of flows from different wells. Using an optimistic approach a station will be built with oversized pipe and equipment anticipating a target growth size. Until that size is reached, the extra cost of the larger initial infrastructure burdens the economics for the site. If a station outgrows its target size, then the current infrastructure must be re-built to handle the added site capacity—an expensive and often fatal economic blow to the expansion plans.

Traditional compressor facility designs are progressing into a mode where equipment modularization is perceived as a cost saving design and construction advantage. Previous modularization efforts, however, simply mimic the usual approach of using separate pieces of equipment connected with separate utility and process piping systems. This usually results in a large site with extensive site civil works, with lengthy and expensive construction schedules.

A compressor station is a facility which helps the transportation process of natural gas from one location to another. A gathering compressor station is used as a centralized location where several wells in an area send their flows. Though natural gas is considered "dry" as it passes through a pipeline, the raw gas from the wells is saturated with liquids in the form of hydrocarbons or water. This liquid condenses in the pipes leading to the compressor station and eventually flows into the station from planned pigging operations or as unplanned slugs of free liquids. Compressor stations typically include equipment such as slug catcher vessels, scrubbers, strainers or filter separators which remove liquids, dirt, particles, and other impurities from the natural gas. These removed impurities from the gas are disposed as waste or sold if possible. There are roughly five major parts of a station design. These are generally broken into the following categories: Inlet Systems; Compression; Discharge Systems; Dehydration; and Utilities.

Previous Inlet Slug Catcher systems work by routing all of the incoming gas and liquid through a large steel vessel where the gas slows down enough for any liquids to fall to the bottom of the vessel. Additional mechanical methods such as demisters or vane packs are sometimes employed in the vessels to assist with liquid separation. Since the vessel size is limited by shipping dimensions (and weight), additional liquid storage space is often added; these storage spaces are commonly referred to as "finger skids". From the temporary storage in the vessel and finger skids, the liquid is slowly drained into liquid pipes, known as liquid "headers"; that run throughout the facility. These pipe systems carry the gathered liquids to on-site storage tanks or processing systems. The liquid-free gas is then routed to the compressor suction via piping, systems known as gas "headers".

The inlet to a compressor station must be designed to the possible future size of the facility since it is generally intended to be a gas receipt point from multiple wells over a number of years. This process is always filled with compromise since the general industry mindset is to "build it once", but with increasing size comes higher initial cost. Sizing the inlet system is usually a problematic issue. When sizing a gathering facility's inlet system, the Engineer needs to evaluate possible gas pressures and flow rates that could occur over time. The evaluation starts with identifying the possible mix of liquids and gases that comes up from a gas well. Usually the Producer (well owner) installs a steel vessel at the well location to separate the free liquid from the gas. If this equipment malfunctions or is not properly operated, some or all of these free liquids can be sent with the gas to the compressor station. Even when well pad separation equipment is properly operated, the gas leaving the well, pad is still saturated with liquids (analogous to a "fog"). The gas cools as it runs through underground piping to a compressor facility. When the "fog" cools it condenses, or "rains", inside the pipe. To keep the pipe from filling with condensate over time, the pipeline Operators will run a "pig" (analogous to a rubber "squeegee") through the line to push the liquids out of the pipe. This liquid ends up coming into the compressor station as a "slug" of liquid. Depending on the gas composition, frequency of the pigging, terrain "ups mid downs", the amount of gas flowing through the line, distance from the wells, and ambient conditions, the liquid volumes can vary. There are always unknown variables that can affect the amount of liquids coming into a station. One of the biggest unknowns is how much gas will end up flowing to the proposed station since higher gas flows carry more saturated liquids which in turn increase the condensate volumes. All of these factors make the "one-time" initial sizing of compressor station inlet separation (Slug Catcher) equipment a frustrating challenge.

The second part of an inlet system is an inlet filter separator vessel. This piece of equipment is installed downstream of the Slug Catcher as a secondary system to prevent any liquid that may get past the Slug Catcher from making its way to the compressors. This unit generally has two internal sections, one for trapping free liquids, and a second filter element section used to trap any airborne particulates. In the traditional vessel design, each of these two internal systems drain into separate sump partitions within the vessel and then on through a set of redundant automated drain systems to a facility liquid drain pipe.

After traversing the inlet system, liquid-free gas then goes through a series of piping systems to the compressors. All of these main artery lines throughout the facility are sized for a maximum flow at a given pressure. As previously mentioned, this sizing for future flow conditions is part educated guesswork tempered with an analysis balancing costs with the risk of under or oversizing the infrastructure. Once the gas lines reach the compressors, a branch line is routed to each machine. Each compressor size requires more or less flow, and the piping systems to and from each machine must be sized to the specific operating conditions for each machine.

Each compressor generates liquid through normal operation of cooling the compressed gas. Additional liquid sources from the packaged compressor include drain systems on the compressor skid, oil changes, etc. This liquid from each individual packaged compressor is generally routed to a main liquid drain pipe line that is run along the spaced compressor installations. In many facilities, there are two main liquid drain pipe lines. One line is dedicated to high pressure drain liquids and the other to low pressure drain liquids. In many designs, these lines are both routed separately to on-site storage tanks for disposal or further processing needs.

When a reciprocating compressor (piston units "smashing" the gas) compresses gas, oil is injected to keep the pistons lubricated. Some of this oil ends up in the gas as it leaves the compressor. It needs to be removed. The discharge gas from each compressor is traditionally run to a station-sized common discharge pipe "header". This compressor discharge gas piping is routed along the same stretched out multi-compressor arrangement and the discharge gas from each machine is sent to this common pipe. To remove the oil from the discharge gas, another filter separator vessel is installed. The common discharge pipe header routes the combined discharge gas from many compressors to a common discharge oil separator vessel. This filter vessel generally has the same functional features as the inlet filter separator vessel. The traditional two stage vessel design uses the same drain system arrangement with one drain from the pre-filter portion of the internals, and a second from the post-filter element section of the vessel internals. Each of these drain connections are traditionally directly routed to dedicated sumps included as part of the traditional vessel design. Each of the traditional two sumps provided with the vessel supply has a drain connection that is connected through a plurality of pipes to the main facility drain, pipe(s) routed to the vessel area. Each of the drain systems directly connected to the vessel uses manual isolation valves, strainers, backflow prevention valves, bypass valves, and automated valves which are controlled by instrumentation systems on the vessel that monitor level in each sump area. Because of known frequent failures/malfunctions with the automated drain systems, traditional installations use redundant drain systems at each drain connection. As with the inlet filter separator vessel, it is difficult to size the discharge oil separator since sizing of the vessels involves some assumptions for the maximum required size (for a fully-grown station) or it involves leaving provisions for future parallel installations which require-extra costs both during the initial station build and again when equipment is added.

In some facilities, a dehydration system is installed to remove saturated water content from the gas. This process is generally performed by forcing the gas through a vertical vessel called the dehydration contactor tower where the gas is brought into "contact" with liquid glycol pumped through the tower. Any saturated water in the gas has an affinity for the glycol and the gas is dehydrated (water removed) in the dehydration contactor tower. Since some liquid glycol droplets may be carried through the dehydration contactor tower with the exiting gas, a glycol filter separator vessel is typically installed downstream of the dehydration contactor tower. Similarly the previously described inlet filter and discharge oil separator vessels, the glycol filter separator vessel is usually a traditional two stage vessel design that uses the dual drain system arrangement with one drain from the pre-filter portion of the internals, and a second from the post-filter element section of the vessel internals. Each of these drain connections are traditionally directly routed to dedicated sumps included as part of the traditional vessel design. Each of the traditional two sumps provided with the vessel supply has a drain connection that is connected through a plurality of pipes to the main facility drain pipe(s) routed to the vessel area. Each of the drain systems directly connected to the vessel uses manual isolation valves, strainers, backflow prevention valves, bypass valves, and automated valves which are controlled by instrumentation systems on the vessel that monitor level in each sump area. Because of known frequent failures/malfunctions with the automated drain systems, traditional installations use redundant drain systems at each drain connection.

All of the previously described systems are typically designed to perform their functions for the entire compressor facility where there are multiple compressors. This leads to several common problems. For example, the inlet system must be designed to feed several compressors. However, due to the changing nature of natural gas drilling and production, it is unusual that all the compressors planned for any site are needed and installed with the initial facility build. Therefore, the installed size (or capacity) of an inlet system rarely matches the installed compression needs at any given site. Oversizing the infrastructure for planned expansion results in extra costs for the initial station build. The penalty for under-sizing the same infrastructure could be that future expansion needs are prohibitively expensive.

Previous practices for handling liquids generated at a compressor station are complicated and expensive. In traditional station design practice, each equipment drain outlet is directly connected to a plurality of pipes with redundant drain appurtenances, all of which are piped to the appropriate facility low or high pressure main drain pipe line. As stated above, the traditional industry practice is to have instrumentation and controls for each different type of drain source along with triple redundancy via two parallel automated drain valve systems with a third manual valve bypass as a back-up. The automated drain valves are controlled by instrumentation installed to measure and control the level in the vessel sump associated with each drain outlet. Each of the redundant drain systems requires inlet and outlet isolation valves, vents and drains, an automated valve, and a strainer. The isolation valves are required for performing maintenance on the automated drain valves and the strainers are located upstream of the automated valves to keep any in-line debris from fouling the automated valves.

Drain pipes in previous designs are almost always restricted because the automated valves are known to fail open. When a valve fails open if creates a path for gas to chase the dump liquid down the pipe all the way to the site storage tanks. The high pressure gas then expands in the tank(s) and vents out the top of the storage, tanks until the malfunctioning valve is taken out of service and one of the redundant back-up drain systems is brought online. Since the storage tanks are often designed and fabricated as low pressure (atmospheric) tanks there is always a risk of overwhelming the storage tanks with high pressure gas which can cause the tank to fail. Due to this concern, traditional liquid dump connections usually install pipe restriction orifices or choke nipples to limit the amount of gas that can escape when an automated valve fails. These flow restriction devices also back up the liquid that is trying to dump resulting in slow drainage, freezing concerns, and possible station shutdowns due to high liquid levels in the equipment. Because it is inevitable that the automated valves will fail, it would be desirable to simplify the facility liquid drain systems and minimize use of level-control drain valves. It would also be desirable to decrease the number of drainage pipes running throughout the facility connecting each of the drain sources to the respective low or high pressure main drain pipe(s). A simplified approach to handling liquids at a compressor station would cut down initial costs and further minimize failures that lead to shutdowns and unplanned gas emissions. What is needed is a system that performs all the above described functions for compressor facilities that can be designed to be the proper size based on initial installation need, but that can be easily expandable when it becomes necessary.

SUMMARY OF THE INVENTION

Disclosed is an assembly that is an all-in-one combination of piping and equipment systems designed to provide a compact, simple, pre-fabricated assembly on single skid platform to meet all the functional needs of a petrochemical gas compression facility. This skid platform assembly is intended to be used with individual gas compressors of various sizes, with or without downstream dehydration systems. The skid platform assembly provides a traveling pathway for the fluid generated from a well and is designed to provide all required pre-compressor and post-compressor functional equipment needs for each individual installed gas compressor. The pre-compressor and post-compressor functional equipment includes, but is not limited to:

Common Gas Inlet Pipe Header
Gas Inlet ESD (Emergency Shutdown) automated valve (optional)
Gas Inlet emergency Blowdown automated valve (optional)
Inlet Slug Catcher/Separator function using an integral inlet separator design
Inlet Slug Catcher Liquid PSO (positive shut off) system (optional)
Skid Inlet Gas Pipe
Inlet Filter Separation vessel
Isolation and bypass piping and valves for maintenance of Inlet Gas Filter Separator vessel
Drain systems for Inlet Gas Filter Separator vessel equipment needs
Individual compressor suction piping and valves to isolate the compressor from the inlet header
Compressor Inlet/Suction pressure control valve needs
Compressor system pressurizing valves and piping
Compressor system de-pressurizing valves and piping
Discharge piping and isolation valves for individual compressor isolation from discharge header
Discharge Gas Oil Separation vessel
Drain systems for Discharge Gas Oil Separator equipment needs
Isolation and bypass piping and valves for maintenance of Discharge Gas Oil Separator vessel needs
Dehydration Contactor Tower (optional)
Glycol Separation vessel (optional)
Isolation and bypass piping and valves for maintenance of Glycol Separator vessel
Drain systems for Glycol Separation vessel equipment needs
Gas Discharge pipe header
Gas Discharge ESD (Emergency Shutdown) automated valve (optional)
Gas Discharge emergency Slowdown automated valve (optional)
Integrated Liquid Disposal Piping for all liquid condensate dump needs
Fuel Gas conditioning and metering for each compressor (and dehydration unit, if required)
Compressor Start Gas supply
Instrument Gas supply Disclosed is a skid platform assembly with an integrated liquid separator that also functions as a amnion liquid sump for all liquid generated by the functional equipment associated with a petrochemical gas compressor installation. All inlet gas and liquids enter in an integral inlet separator that is located on each skid, the integral inlet separator may be comprised of either a large diameter pipe segment or pressure vessel that is designed to achieve liquid separation. The integrated inlet separator is installed near grade elevation. The integral inlet separator design on each skid functions as the common liquid sump for incoming liquid condensate slugs and compressor facility liquid drain sources. Flow into the integral inlet separator design is restricted to the compressor flow rate. This design feature balances flow into each skid's integral inlet separator and allows for proper sizing of each skid system.

Each skid platform assembly includes a common gas inlet pipe header and a common gas discharge pipe header. These pipes are sized for single or multiple skid applications. When multiple skids are installed in series the common inlet and discharge pipe headers are used to connect the skids together. Since each skid design includes an integrated inlet separator, the liquid handling capacity of the facility grows proportionally with the number of skids installed.

Some advantages of the skid design:

Each single-skid platform assembly has all piping and equipment needed for a single compressor installation including an integral inlet separator dedicated to one compressor. In previous designs, at a minimum, the inlet separator is a single vessel which is sized for the anticipated flow capacity of the fully-developed facility servicing multiple compressors, and is installed as a standalone piece of equipment connected via facility-sized pipe headers to other equipment at the site.

The drain on the first stage of the inlet filter separator vessel functions as a gravity drain. This is done by mounting the inlet filter separator vessel above the integral inlet separator to allow hydraulic head pressure to drain the low pressure liquids from the inlet filter separator vessel back into the integral inlet separator.

The skid assembly system utilizes direct draining (no automated valves) from pressurized sources back to the integral inlet separator. Any liquid drain pipes with pressure higher than the system inlet pressure will drain directly into the integral inlet separator acting as a common sump. This includes any liquid drain pipes from compressor discharge equipment such as the discharge gas oil separator and the optional glycol separator vessel.

The skid assembly system eliminates gas emissions and wasted gas normally seen with traditional designs. With each drain source fluidly connected to the integrated inlet separator, gas is automatically recycled back to compressor.

The design eliminates sizing guesswork for expanding or shrinking facility needs. The integral inlet separator design allows the facility inlet separator capacity to grow in proportion to the number of skids (and compressors) added to a facility. When more compressors are needed then one skid per compressor is added. By adding multiple skids in series, the facility inlet separator capacity grows. The amount of liquid slug volume handled by a series of individual skids bolted together and working as a single system is multiplied by each added skid. This improved design is always sized correctly for whatever the number of compressors are installed at a site.

The design reduces the overall facility valve count including most large bore valves and eliminates the need for multiple equipment-related redundant automated drain valves, as well as the associated equipment mounted instrumentation and controls.

Facility costs using the skid in this disclosure are lower than traditional design/construction methods.

SHORT DESCRIPTION OF FIGURES

DETAILED DESCRIPTION

The figures described below are intended to illustrate one embodiment of the invention. The following descriptions refer collectively to the figures and the numerals which are used to clarify the claimed invention. Pipe and valve arrangements are illustrated in the figures to show their presence and function but the claimed invention is not limited to the specific arrangements illustrated by the figures.

Figure 1:
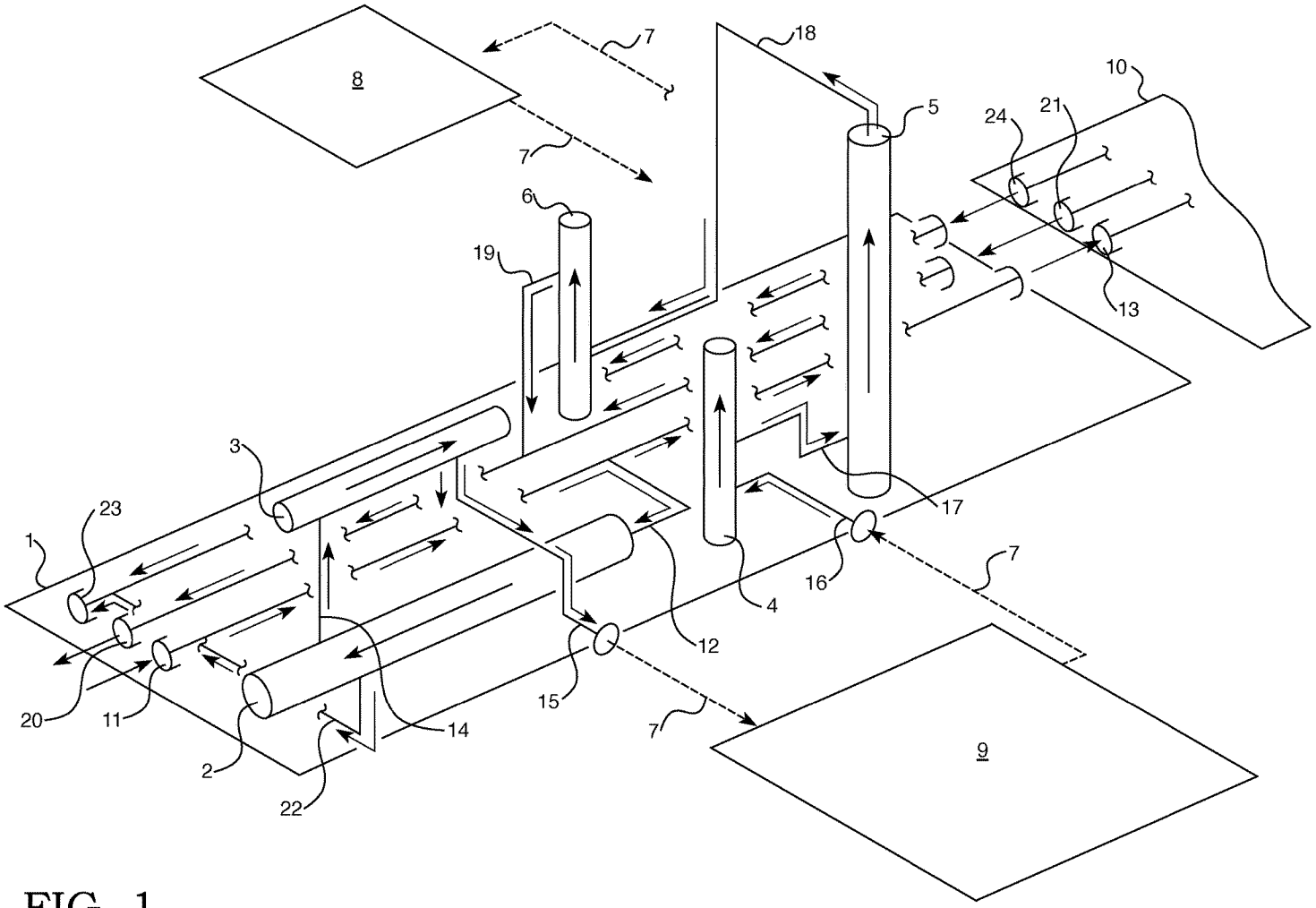
FIG. 1 is a schematic view depicting one embodiment of the All-in-One skid, showing an installation that includes the optional integrated dehydration contactor tower and the optional integrated glycol separator vessel.

FIG. 1 shows one embodiment of All-in-One skid assembly 1. This single platform is comprised of a plurality of on-skid equipment including the integral inlet separator 2, the inlet filter separator vessel 3, a discharge oil separator vessel 4, a dehydration contactor tower 5, and a glycol separator vessel 6. This installation includes field-installed interconnecting piping 7 shown with arrows indicating flow direction to and from a dehydration regeneration skid 8 and a packaged compressor 9. A future additional all-in-one skid 10 is shown to the top right.

Flow arrows are shown on FIG. 1 to indicate the direction of the traveling pathway of the flow of the fluid generated from a well through the system. All flow to the skid system enters through the common gas inlet pipe header 11 and flow to the systems on each skid is sent through the skid gas inlet pipe 12 to the integral inlet separator 2. When multiple skids are installed in series the inlet flow continues down the common gas inlet pipe header 11 to the common gas inlet pipe header connection 13 on the future additional all-in-one skid 10. Gas and condensate are separated in the integral inlet separator 2 and the gas flows up the pipe-to-inlet filter 14 to the inlet filter separator vessel 3. Gas flows out of the inlet filter separator vessel 3 through the compressor inlet pipe 15 to the packaged compressor 9 via field-installed interconnecting pipe 7.

Compressor discharge gas flows from the packaged compressor 9 via field-installed interconnecting pipe 7 to the skid's compressor discharge pipe 16 and on to the discharge oil separator vessel 4. The gas flows from the discharge oil separator vessel 4 through the oil free discharge pipe 17 to the dehydration contactor tower 5. Gas from the dehydration contactor tower 5 flows through the dehydration tower-to-glycol separator pipe 18 to the glycol separator vessel 6 and on through the dry gas discharge pipe 19 to the common gas discharge pipe header 20. The common gas discharge pipe header 20 has connections at either end of the skid for overall gas outlet or to mate with the common gas discharge pipe connection 21 on a future additional all-in-one skid 10; whenever multiple skids are connected in series.

Condensate from the integral inlet separator 2 is drained through the integral inlet separator drain pipe 22 to the common liquid drain pipe header 23 which has connections at either end of the skid for an overall liquid drain outlet or to mate with the common liquid drain pipe header connection 24 on a future additional all-in-one skid 10; whenever multiple skids are connected in series.

Figure 2:
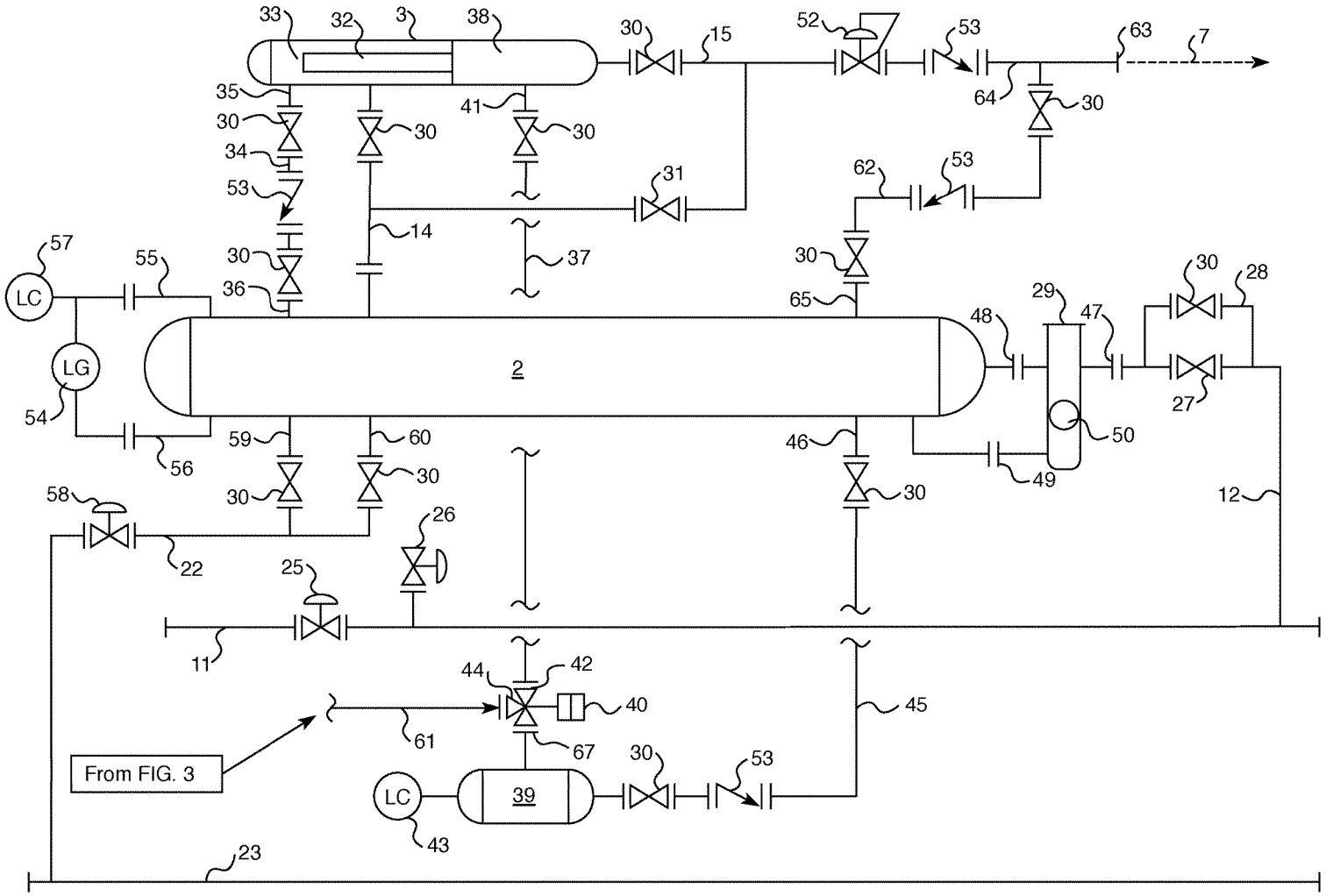
FIG. 2 is a schematic view depicting one embodiment of the All-in-One skid assembly focusing on the low pressure inlet equipment and piping systems.

The view depicted in FIG. 2 shows the common gas inlet pipe header 11 with the skid gas inlet pipe 12 connecting to the integral inlet separator 2. The common gas inlet pipe header 11 is preferably flanged on each end and is designed to provide flow for one or more like skids connected in series. An inlet ESD (emergency shutdown) automated valve 25 may be installed at the inlet to this pipe. An optional blowdown automated valve 26 may be installed downstream of the inlet ESD automated valve 25 to vent gas from the inlet piping (or "de-gas" the skid) during an emergency. The skid gas inlet pipe 12 includes an inlet isolation valve 27 and pressurizing pipe 28 upstream of the inlet slug catcher liquid PSO system 29. Though use of an inlet slug catcher liquid PSO system 29 is preferred, it is an optional piece of equipment.

The pressurizing pipe 28 is a small diameter bypass around the inlet isolation valve 27 that allows the skid system downstream of a closed inlet isolation valve 27 to be slowly pressurized in lieu of opening the larger diameter inlet isolation valve 27. Once pressure is equalized on both sides of the inlet isolation valve 21 then the larger diameter inlet isolation valve 27 is opened and the generic isolation valve 30 on the smaller diameter pressurizing pipe 2S is closed. This is useful to prevent any damage from suddenly pressurizing downstream pipe and equipment with a large volume of gas and condensate which is possible if the pressurizing pipe is not used.

Inlet fluid enters the inlet slug catcher liquid PSO system 29 from the skid gas inlet pipe 12 at the PSO inlet connection 47. The inlet slug catcher liquid PSO system 29 connects to the integral inlet separator 2 via both a PSO upper discharge connection 48 and a PSO lower discharge connection 49. All gas and condensate entering the skid through the skid gas inlet pipe 12 flows through the inlet slug catcher liquid PSO system 29 into the integral inlet separator 2 and a discharge of condensate flowing from the integral inlet separator 2 through the PSO lower discharge connection 49 influences a mechanical float 50 inside the inlet slug catcher liquid PSO device 29 to rise and fall in coordination with the condensate level inside the integral inlet separator 2; when the condensate level rises to a maximum design condensate level inside the integral inlet separator 2, the mechanical float 50 will rise to plug the PSO inlet connection 47 and therefore stop all flow to the integral inlet separator 2 until the condensate level inside the integral inlet separator 2 is lowered via the integral inlet separator drain pipe 22.

The pipe to inlet filter 14 connects the integral inlet separator 2 to the inlet filter separator vessel 3 with generic vessel isolation valves 30 and a generic vessel bypass valve 31 used for maintenance needs. The generic filter element 32 is located within the first stage of the inlet filter separator vessel 33. A gravity drain pipe 34 is connected on an upper side to the gravity drain outlet connection 35 on the inlet filter separator vessel 3 and on a lower side to the gravity drain inlet connection 36 on the integral inlet separator 2. Any liquids that condense out in the first stage of the inlet filter separator vessel 33 are gravity drained back to the integral inlet separator 2 using this design. The inlet filter separator vessel 3 being mounted above the integral inlet separator 2 allows hydraulic head pressure to drain the liquids from the first stage of the inlet filter separator vessel 33 back into the integral inlet separator 2. Liquids from the second stage of the inlet filter separator vessel 38 drain into the low pressure drain pipe 37 through the low pressure drain connection 41 and continue to the diverter valve low pressure drain pipe connection 42 on the level control automated diverter valve 40 which is connected to the blowcase vessel 39.

The level control automated diverter valve 40 has two inlet connections, 42 and 44, and one outlet connection 67 into the blowcase vessel 39. In normal operation, the level control automated diverter valve is opened to allow liquids from the inlet filter separator vessel 3 to drain through the low pressure drain pipe 36 into the blowcase vessel 39. When the blowcase vessel 39 is full of liquid, the blowcase level controller 43 will actuate the level control automated diverter valve 40 to close off the diverter valve low pressure drain pipe connection 42 and open the diverter valve pressurized feed gas pipe connection 44 which allows the pressurized gas from the pressurized feed gas pipe 61 to blow the liquid from the blowcase vessel 39 through the blowcase pressurized drain pipe 45 into the integral inlet separator 2 at the blowcase drain inlet connection 46. When the blowcase condensate level drops, the blowcase level controller 43 will actuate the level control automated diverter valve 40 to close off the diverter valve pressurized feed gas pipe connection 44 and open the diverter valve low pressure drain pipe connection 42; a small residual volume of the pressurized gas in the blowcase vessel 39 is vented up the low pressure drain pipe 37 into the second stage of the inlet filter separator vessel 38 joining gas that is already present having come from the first stage of the inlet filter separator 33, and the joined gas flows out of the second stage of the inlet filer separator 38 towards the packaged compressor 9.

During compression, gas flows out of the inlet filter separator vessel 3 through the compressor inlet pipe 15 to the compressor inlet suction control valve 52, through a generic backflow preventer valve (check valve) 53, and out through the skid-edge skid to compressor connection 63. Field-installed interconnecting piping (see numeral 7, FIG. 1) connects the skid to compressor connection 63 to the packaged compressor (see numeral 9, FIG. 1).

The pressure equalizing pipe 62 connects to the compressor inlet pipe 15 at the equalizing pipe inlet connection 64 downstream of the compressor inlet suction control valve 52. The pressure equalizing pipe 62 connects the compressor inlet pipe 15 to the integral inlet separator 2 at the equalizing pipe outlet connection 65. The pressure equalizing pipe 62 includes generic isolation valves 30 and a generic backflow preventer valve (Check valve) 53 to prevent flow back from the integral inlet separator 2 during normal compressor operation. When the packaged compressor (see numeral 9, FIG. 1) is stopped for any reason, compressor discharge gas is trapped in the machinery at a high pressure, the pressure equalizing pipe 62 allows this trapped high pressure compressor discharge gas to automatically depressurize into the integral inlet separator 2 via the pressure equalizing pipe 62. Generic vessel isolation valves 30 and generic backflow preventer valves (Check valves) 53 are illustrated solely to reflect their presence and function rather than the final embodiment of the invention.

The condensate level inside the integral inlet separator 2 is measured by a level gauge 54 connected to the integral inlet separator 2 at an upper level gauge connection 55 and at a lower level gauge connection 56. The integral inlet separator level controller 57 is installed with the level gauge 54 and is used to control an automated drain valve 58 located on the integral inlet separator drain pipe 22. When the condensate level rises up to the upper level gauge connection 55, the integral inlet separator level controller 57 opens the automated drain valve 58 allowing the condensate to drain and when the condensate level inside drains down to the lower level gauge connection 56, the integral inlet separator level controller 57 closes the automated drain valve 58. The integral inlet separator level controller 57 can be either a pneumatic controller or electronic controller. The integral inlet separator drain pipe 22 is connected to the integral inlet separator 2 at a primary liquid drain connection 59 and a secondary liquid drain connection 60 and the integral inlet separator drain pipe 22 directs liquids drained from the integral inlet separator 2 to the common liquid drain pipe header 23 which runs the length of the skid and can be flanged on both ends to allow connection between adjacent future all-in-one skids (see numeral 10, FIG. 1).

Figure 3:
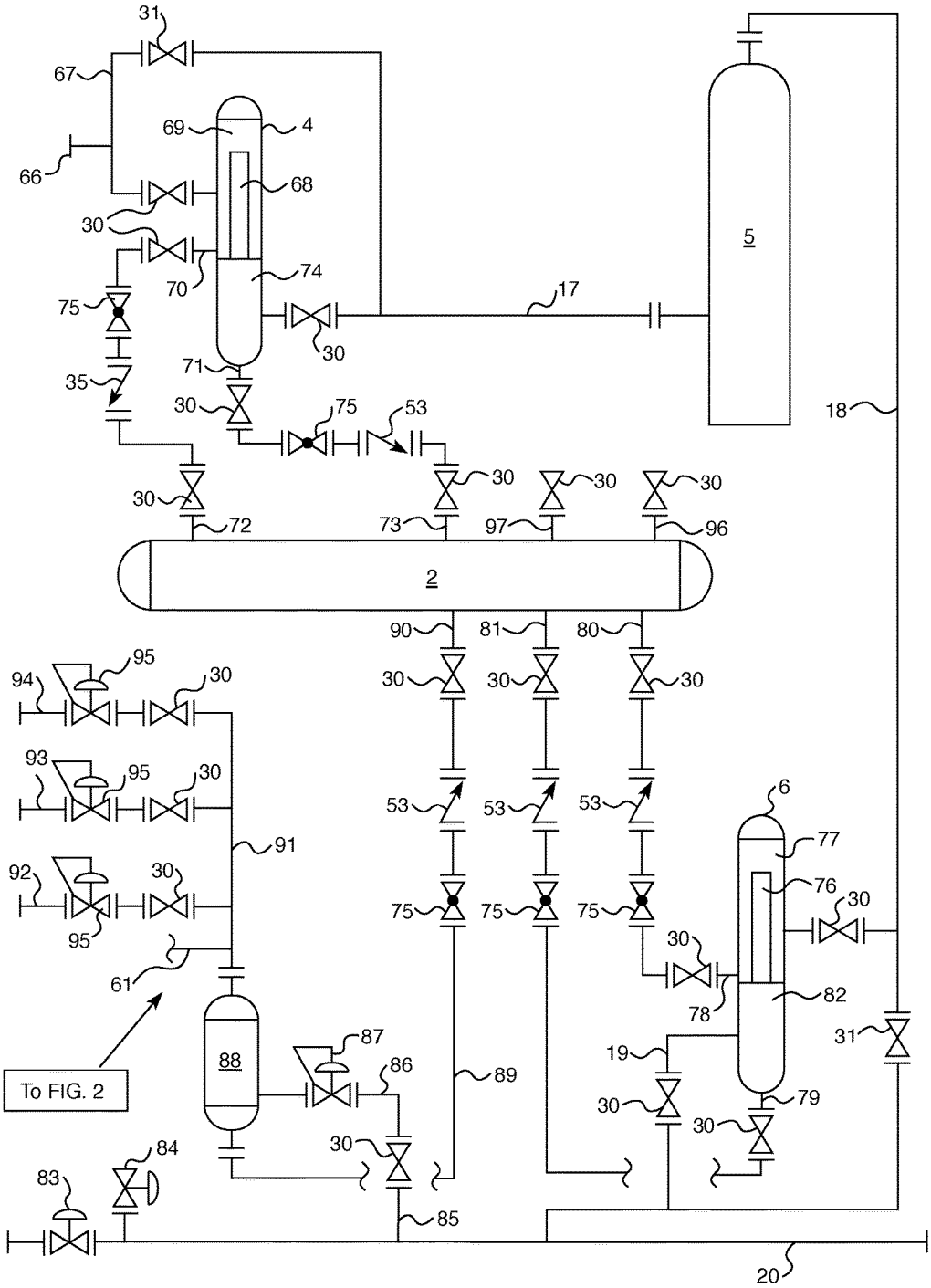
FIG. 3 is a schematic view depicting one embodiment of the All-in-One skid assembly focusing on the high pressure equipment and piping systems.

FIG. 3 shows the compressor to skid connection 66 where field piping (see numeral 7, FIG. 1) connects the All-in-One skid (see numeral 1, FIG. 1) to the packaged compressor (see numeral 9, FIG. 1). High pressure compressor discharge gas is routed to the discharge oil separator vessel 4 through the compressor discharge pipe 16 which includes generic vessel isolation valves 30 and a generic vessel bypass valve 31 which are located at the discharge oil separator vessel 4 for vessel maintenance needs. The generic filter element 68 is located inside the first stage of the discharge oil separator vessel 69. The oil separator pressurized first stage drain 70 connects to the oil separator first stage drain connection 72 on the integral inlet separator 2 and the oil separator pressurized second stage drain 71 connects to the oil separator second stage drain connection 73 on the integral inlet separator 2. Gas flows out of the discharge oil separator vessel 4 through the second stage of the discharge oil separator vessel 74 out to the oil free discharge pipe 17. Globe-type pressure reducing valves 75 are installed in both the oil separator pressurized first stage drain 70 and the oil separator pressurized second stage drain 71 to reduce the pressure and flow from these drain sources to the integral inlet separator 2. Generic isolation valves 30 and generic backflow preventer valves (Check valves) 53 are illustrated solely to reflect their presence and function rather than the final embodiment of the invention.

When the optional dehydration contactor tower 5 and glycol separator vessel 6 are installed on the skid, the gas is routed through the oil free discharge pipe 11 to the dehydration contactor tower 5. Gas from the on-skid dehydration contactor tower 5 is routed through the dehydration tower-to-glycol separator pipe 18 to the glycol separator vessel 6. The dehydration tower-to-glycol separator pipe 18 includes generic vessel isolation valves 30 and a generic vessel bypass valve 31 which are located at the glycol separator vessel 6 for vessel maintenance needs. The generic filter element 76 is shown inside the first stage of the glycol separator vessel 77. The glycol separator pressurized first stage drain 78 connects to the glycol separator first stage drain connection 80 on the integral inlet separator 2. The glycol separator pressurized second stage drain 79 connects to the glycol separator second stage drain connection 81 on the integral inlet separator 2. Gas flows out of the glycol separator vessel 6 through the second stage of the glycol separator vessel 82 out to the dry gas discharge pipe 19. Globe-type pressure reducing valves 75 are installed in both the glycol separator pressurized first stage drain 78 and glycol separator pressurized second stage drain 79 to reduce the pressure and flow from these drain sources to the integral inlet separator 2. Generic isolation valves 30 and generic backflow preventer valves (check valves) 53 are illustrated solely to reflect their presence and function rather than the final embodiment of the invention. The dry gas discharge pipe 19 connects to the common gas discharge pipe header 20.

If the on-skid dehydration contactor tower 5 and glycol separator vessel 6 are not included on the All-in-One skid (see numeral 1, FIG. 1) then the oil free discharge pipe 17 may connect to off-skid field-installed interconnecting piping (see Numeral 7, FIG. 1) or directly to the common gas discharge pipe header 20.

Gas leaves the skid through the common gas discharge pipe header 20. This pipe is designed to handle the gas flow of one or more like skids connected in series. An optional discharge ESD (emergency shutdown) automated valve 83 may be installed at the discharge of this pipe. An additional optional discharge Blowdown automated valve 84 may be installed upstream of the discharge ESD automated valve 83 to vent gas from the discharge piping during an emergency.

An auxiliary system is installed to provide utility gas services. Specific design features of this system are dependent on operating pressures and gas composition. One embodiment of this configuration is shown starting with the utility gas outlet connection 85 on the common gas discharge pipe header 20. High pressure gas flows through the high pressure utility gas feed pipe 86 to the first pressure cut regulator 87 which lowers the pressure to be slightly higher than the inlet gas pressure in the integral inlet separator 2. Any condensate from this pressure reduction is filtered in the utility systems filter 88 and drained via a pressurized utility drain pipe 89 into the utility system drain connection 90 on the integral inlet separator 2. A globe-type pressure reducing valve 75 is installed in the pressurized utility systems drain pipe 89 to reduce the pressure and flow from this drain source to the integral inlet separator 2. Gas exits the utility systems filter 88 through the reduced pressure utility gas feed pipe 91 which has connections for the pressurized feed gas pipe 61 that provides gas to the blowcase vessel (see numeral 39, FIG. 2) and to the fuel gas pipe 92, the starting gas pipe 93, and the instrument gas pipe 94. Generic additional regulators 95 may be used to meet the pressure(s) required by the fuel gas pipe 92, start gas pipe 93 and instrument gas pipe 94 as may be required. Generic isolation valves 30 are illustrated solely to reflect their presence and function rather than the final embodiment of the invention.

Additional inlet connections on the integral inlet separator 2 are provided for off-skid liquid condensate discharge sources such as the packaged compressor drain connection 96, and the dehydration regeneration drain connection 97. Genetic isolation valves 30 are illustrated solely to reflect their presence and function rather than the final embodiment of the invention.

The All-in-One skid assembly 1 uses an integral inlet separator 2 sized for gas flow requirements to an individual gas compressor within a facility. Previous liquid/gas separation systems are intended to separate the gas and liquids prior to arrival at a compressor facility or as a set-sized piece of equipment installed at the inlet to service an entire compressor station. So therefore, previous designs only use a single separator for an entire compressor facility. The All-in-One skid assembly 1 uses this similar separation approach, however the piece of equipment functioning as a slug catcher (i.e. the piece of equipment used for liquid/gas separation), the integral inlet separator 2, is a design that is integrated directly into an individual compressor's inlet piping, a construct not seen with previous designs. So therefore, for the disclosed design, each compressor has its own individual separator. The benefit of using an All-in-One skid assembly 1 with the integrated inlet separator 2 is that the system is expandable for when compressors are added to the facility. An additional All-in-One skid assembly (see FIG. 1, numeral 10) is installed with each added packaged compressor (see FIG. 1, numeral 9) as the facility grows. The infrastructure needed for each added packaged compressor (see FIG. 1, numeral 9) is included with the All-in-One skid assembly 1.

As described above, the core of the All-in-One skid assembly 1 is comprised of an integral inlet separator 2 connected to a two phase facility inlet stream that brings the fluid from a well which is a mixture of gas and liquid to the All-in-One skid assembly 1. The fluid from the well is routed via the common gas inlet pipe header 11 through each All-in-One skid 1. The common gas inlet pipe header 11 diameter is determined by the number of All-in-One skids that will be connected in series. Multiple groupings of All-in-One skids may be installed at a facility depending on flow requirements and economics of the pipe sizing required for each series of All-in-One skids. Off-skid equipment drains are routed via skid and field-installed interconnecting piping 7 into drain inlet connection 96 and dehydration regeneration drain connection 97 provided on the integral inlet separator 2. All of the on-skid and off skid liquid drain sources include outlets from various vessels via both gravity and pressure drains, and discharge from one or more blowcases (or similar sources). The presence of all these inlet connections enables the integral inlet separator 2 to act as the common pipe sump and allows the All-in-One skid 1 to provide all the functions a compressor facility needs per individual compressor.

The integral inlet separator 2 inlet needs to be of sufficient volume to temporarily isolate and to contain an incoming liquid condensate slug. Preferably, the integral inlet separator 2 design uses a large diameter pipe (such as a standard 24", 36" or 48" pipe) or pressure vessel. Flow to each skid is limited by the amount of gas that the specific compressor can flow. This allows for proper sizing of the inlet separation equipment. The volume selected for any specific compressor should be large enough to handle the liquid slug and to provide enough open area for incoming gas flow to that compressor. The integral inlet separator 2 on each skid is sized to slow down all Inlet liquid/gas flow for initial separation, and to provide temporary liquid volume holding capacity for all possible liquid sources from facility operation.

Multiple All-in-One skids 1 can be connected in series up to the calculated volume capacities of the common gas inlet pipe header 11 and the common gas discharge pipe header 20. Liquid slugs coming through the common gas inlet pipe header 11 are distributed to each of the individual skid integral inlet separators evenly due to a combination of the restricted compressor inlet flow through each skid and by pressure balancing between the skids. As liquid level rises in one skid's integral inlet separator 2, the gas volume in the integral inlet separator 2 decreases and the internal pressure rises. Liquid will naturally seek out the lowest pressure path for flow and the liquid flow will be distributed evenly through a series of connected All-in-One skids. Multiple groupings of All-in-One skids connected in series may be used at the same facility to provide nearly endless expansion capacities.

The optional inlet slug catcher liquid PSO system 29 ensures that unexpected inlet liquid slug volumes to the facility do not overwhelm the site liquid handling capacity and cause possible damage to downstream equipment. The mechanical float 50 is designed to rise with condensate level inside the integral inlet separator 2 and it will isolate the PSO inlet connection 47 when a maximum liquid level is reached in the integral inlet separator 2. Flow to the integral inlet separator 2 is isolated until the liquid condensate level inside the integral inlet separator 2 is lowered through the integral inlet separator drain pipe 22 via the automated drain valve 58 that is controlled by the integral inlet separator level controller 57.

The pipe to inlet filter 14 and compressor inlet pipe 15 systems are sized for optimizing the range of compressor sizes and flow conditions while keeping gas velocities below erosional velocity and to keep the velocity low to minimize sound emissions from the pipe; but the design is flexible so that pipe sizing can be adjusted to meet unexpected conditions without altering the basic All-in-One skid assembly 1 design. The preferred pipe sizes are 6" and 8" diameter for most facilities.

The inlet filter separator vessel 3 is installed in a horizontal orientation on the All-in-One skid assembly 1. The Inlet filter separator vessel 3 is installed at a physical elevation above the integral inlet separator 2 so that liquids separated in the first stage of the inlet filter separator vessel 33 can gravity drain back to the integral inlet separator 2. This is done by using the hydraulic head pressure of any liquids in the gravity drain pipe 34 to overcome the small pressure drop from gas flow through the piping from the integral inlet separator 2 to the first stage of the inlet filter separator vessel 33, and the opening pressure of the generic backflow preventer (check valve) 53 installed in the gravity drain pipe 34. A check valve prevents gas from the gravity drain connection 36 on the integral inlet separator 2 from trying to back-flow up into the gravity drain pipe 34. This gravity drain pipe 34 design is not found in traditional inlet filter separator vessel 3 installations. This gravity drain pipe 34 design is a free draining feature which eliminates the complicated automated drain valve systems typically seen on traditional inlet filter separator vessel drain installations. Another benefit is that the inlet filter separator vessel 3 does not need to be built with the traditional lower sump design as part of the vessel supply. The integral inlet separator 2 serves as both the sump for the inlet filter separator vessel 3 and also as the overall facility condensate drain system. No separate low and high pressure drain pipe "headers" are needed to connect each equipment drain to the site liquid storage. Gas leaks and emissions from normal drain valve operation and especially from malfunctioning automated drain valves (stuck open) are eliminated since any gas leakage through the gravity drain pipe 34 system simply rises back into the pipe-to-inlet filter 14 from the integral inlet separator 2.

As gas continues through the inlet filter separator vessel 3 from the first stage of the inlet filter separator vessel 33 into the second stage of their separator vessel 38, it undergoes a drop in pressure. This is due to the gas passing through a generic filter element 32 which, when dirty, can impart enough pressure losses on the fluid so that any condensed liquids cannot be gravity drained back to the integral inlet separator 2. A low pressure drain pipe 37 from the inlet filter separator vessel 3 connects the second stage of the inlet separator vessel 38 drain to the inlet of a blowcase vessel 39 through a level control automated diverter valve 40. The blowcase vessel 39 is used to accumulate the low pressure liquids and it uses pressurized gas from the pressurized feed gas pipe 61 (which is fluidly connected to the common gas discharge pipe header 20 via the utility systems filter 88 and associated connections) to push liquids into the integral inlet separator 2 through the blowcase pressurized drain pipe 45. All gases used to push liquids into the integral inlet separator 2 are recycled back to the pipe-to-inlet filter 14 by compressor suction emanating through the compressor inlet pipe 15.

The All-in-One skid assembly 1 includes an inlet isolation valve 27 on the skid gas inlet pipe 12 which is used to isolate the individual All-in-One skid systems from other facility gas flow that may be going through the common gas inlet pipe header 11. Similarly, generic vessel isolation 30 and bypass 31 valves on the pipe-to-inlet filter 14 and compressor inlet pipe 15 are designed to allow the operator to isolate and bypass the inlet filter separator vessel 3 for regular maintenance such as filter changes. Since each All-in-One skid assembly 1 is designed to handle the functionality of a single compressor, these same isolation and bypass valves can be used whenever it is necessary to isolate the packaged compressor 9 for any maintenance needs. Reducing the number of valves in the facility is an improvement because it reduces the number of permitted leak points (each valve connection) and it reduces the cost and time for annual leak monitoring for emissions testing. This design minimizes the length of piping systems that may need to be de-gassed for intermittent maintenance needs (as compared to traditional installations); thereby also reducing the environmental impact from the facility operations. Smaller diameter valves are caster for operators to handle, and maintenance/replacement costs are much smaller. This new design simplifies operations and reduces the number of overall valves needs at the facility.

The pressurizing pipe 28 is located at the inlet isolation valve 27 on the skid gas inlet pipe 12. This system is designed to use smaller valves and piping to slowly pressurize the downstream systems. This is required especially with higher pressure inlet conditions when the system goes through commissioning (initial pack and purge gas loading operations), or whenever the system has been de-gassed for maintenance/repairs and needs to be re-pressurized. In systems with higher inlet pressures, opening a larger diameter valve with high differential pressure is difficult, can create wear on the valve, and the sudden high pressure gas flow through a larger valve opening can damage downstream equipment.

Downstream of the inlet filter separator vessel 3 is the compressor inlet suction control valve 52. This valve is sized for the specific needs of whatever reciprocating compressor is installed with the All-in-One skid assembly 1. The compressor inlet suction control valve 52 functions to maintain a target compressor suction pressure to the packaged compressor 9 when pressure in the integral inlet separator 2 varies for any number of reasons. A piping connection located immediately downstream of the compressor inlet suction control valve 52 is for a pressure equalizing pipe 62 which is designed to automatically lower the equalized, or settle out, pressure of a compressor that is stopped for any reason. When a compressor is suddenly stopped it contains unbalanced pressure in the inlet and discharge portions of the packaged compressor 9 machinery and piping. These unbalanced pressures need to be equalized and reduced back to the target inlet pressure to the packaged compressor 9 prior to re-starting the machinery. Piping and valve systems typically supplied on the packaged compressor 9 are designed to "equalize" the overall trapped gas stuck in the machine by opening a conduit between the high and low pressure parts of the system. This "equalized", or "settle-out", pressure is generally too high for the starter provided with the packaged compressor 9 to start the machinery. A typical method used to reduce this equalized pressure is to "blow down" the trapped compressor gases to an atmospheric vent or flare system prior to re-starting the unit. The pressure equalizing pipe 62 installed on the All-in-One skid assembly 1 allows the higher "settle out" pressure gas to automatically recycle back to the integral inlet separator 2 until the pressure is lowered back to the integral inlet separator 3 pressure. Once the packaged compressor 9 is back to the inlet suction pressure, the unit may be re-started without venting or burning any gas.

This pressure equalizing pipe 62 is also used whenever gas may need to be completely cleared from a packaged compressor 9 for maintenance or repair needs. The amount of gas that can be depressurized back into the lower pressure integral inlet separator 2 reduces the emissions from when the gas in the piping and machinery is cleared. Since the integral inlet separator 2 volume is oversized for the compressor needs, it can absorb the small volume of higher pressure gas with little impact to the inlet pressure.

Any drain systems from off-skid sources such as the packaged compressor 9 may be sent to the All-in-One skid 1 through field-installed interconnecting piping 7 to the packaged compressor drain connection 96 provided on the integral inlet separator 2. Liquids may be pushed to the skid via an off-skid blowcase vessel (or similar device). Any gas entrained with off-skid liquid dumps into the integral inlet separator 2 is recycled back to the compressor inlet instead of being possibly vented through an atmospheric tank vent or flared as waste as commonly done in traditional facility designs.

Maintenance needs to any part of the skid assembly and to the packaged compressor 9, and optional dehydration contactor tower 5, require positive isolation from all pressure sources. The previous station design treats each piece of the system as a separate installation and each system requires separate large diameter isolation and bypass valves from the facility main gas pipe "headers". This installation approach was typical for the slug catcher, the inlet filter separator vessel, the compressor inlet suction control valve, the packaged compressor 9, the discharge oil separator vessel, the dehydration contactor tower, and the glycol separator vessel of previous designs. Since the All-in-One skid design integrates all the required equipment for each compressor into the single skid assembly, this allows for one set of isolation valves from the common gas inlet pipe header 11 and the common gas discharge pipe header 20 to be used to isolate everything in the compressor system. This simplifies operation, minimizes costs, and reduces leak points which need annual monitoring and emissions reporting. Since the common systems of the All-in-One skid 1 are sized to handle the needs of a single compressor, the pipe and valve sizes are also smaller than those used in past designs. Another benefit is that when a compressor needs to be taken off-line for routine maintenance, all the systems related to the machine can be serviced without affecting any other compressor systems at the same site.

Gas is sent from each All-in-One skid assembly 1 to the individual compressor via field-installed interconnecting piping 7 run between the skid to compressor connection 63 and packaged compressor 9. When the gas is compressed, a typical reciprocating compressor package uses oil to lubricate the compressor pistons. Some of this oil is carried off with the compressed gas. The oil needs to be removed from the gas for downstream processing and gas quality needs. Pressurized discharge gas from the packaged compressor 9 is routed via field-installed interconnecting piping 7 back to the flanged compressor to skid connection 66 on the All-in-One skid assembly 1. From the compressor to skid connection 66, the compressor discharge pipe 16 is fluidly connected to a discharge oil separator vessel 4 mounted on the skid. The compressor discharge pipe 16 includes generic isolation valves 30 and a generic vessel bypass valve 31 designed to allow an operator to perform maintenance on the discharge oil separator vessel 4. The common isolation valves installed on the compressor discharge pipe 16 are also used for positive isolation for the packaged compressor 9 from all downstream systems. This design simplifies operations and reduces the number of overall valve needs (and emissions) at the facility.

The discharge oil separator vessel 4 is similar to the inlet filter separator vessel 3 in design and function. The commercially available vessel is usually of two stage design with the first stage being on the upstream side of a generic filter element 68 and the second stage is downstream of the filler section inside the vessel. As with the inlet filter separator vessel 3, the All-in-One skid assembly 1 design eliminates the need for the discharge oil separator vessel 4 to be supplied with the traditional dual liquid sumps as part of the vessel supply. The integral inlet separator 2 serves as a common sump for all the liquid systems. The discharge oil separator vessel 4 has two drains; each drain is at high pressure since they are downstream of the packaged compressor 9; the oil separator pressurized first stage drain 70 is for liquids separated prior to the vessel's internal filter elements (or in the first stage of the discharge oil separator vessel 69) the oil separator pressurized second stage drain 71 is for liquids separated downstream of the vessel filter elements (or in the second stage of the discharge oil separator vessel 74). Although the drains are at different pressures from each other, due to additional pressure drop across the generic filter element 68, they are both at pressures higher than the integral inlet separator 2 pressure. The higher operating pressure and the vessel location in the immediate area of the integral inlet separator 2 allow each drain to push liquids at pressure directly into the integral inlet separator 2. This eliminates the need for the traditional dual sump liquid storage system on the vessel, the redundant automated drain valve systems for each vessel sump, and the instrumentation controls installed to operate the now-eliminated automated valve systems.

Globe-type pressure reducing valves 75 are installed to allow each drain system to continuously drain with a small steady flow into the integral inlet separator 2. Generic backflow preventer (check valve(s) 53 are installed in each system to prevent any back flow up from the integral inlet separator 2 in a case where the specific compressor system is down (unpressurized) for any reason. The globe-type pressure reducing valves 75 may be used as a simple substitute to the complex, redundant, unreliable and expensive automated drain systems that traditionally tie in to dedicated drain pipes running throughout a large facility. Any gas that escapes with the draining liquids using the simplified new design is simply released back into the integral inlet separator 2 which feeds the packaged compressor 9 through the new All-in-One skid assembly 1 design. The drain system as designed will lower gas emissions (and losses) compared to traditional liquid drain systems since any gas that vents with the liquids through the pressurized or gravity liquid drain systems is recycled back to the compressor via the integral inlet separator 2 assembly. There may be some minor loss of compressor efficiency since a very small amount of pressurized gas may be escaping back to the low pressure suction, but this is an acceptable tradeoff for simplified operation, reduced maintenance, lower costs, and lower facility emissions. By installing the discharge oil separator vessel 4 in the skid immediately adjacent to the specific compressor, the discharge pipe downstream of the vessel is kept as clean from oil carryover contamination as possible. Since the vessel filter changes and maintenance needs are indicative of the compressor performance, the operator also will have better insight on the performance and settings required for each specific packaged compressor 9. Maintenance and operational adjustments may be made as required.

Once the gas is cleaned of oil by passing through the discharge oil separator vessel 4, it is routed to either an optional on-skid dehydration contactor tower 5, to an off-skid dehydration contactor tower, or to the common gas discharge pipe header 20 depending on customer preference and site needs. Connections to off-skid systems are done through field-installed interconnecting piping 7.

If the optional dehydration contactor tower 5 and glycol separator vessel 6 are installed on the All-in-One skid 1 then the gas from the discharge oil separator vessel 4 is routed to the dehydration contactor tower 5 via the oil free discharge pipe 17 and then from the dehydration contactor tower 3 to the glycol separator vessel 6 via the dehydration tower-to-glycol separator pipe 18. Design advantages and installation details for the glycol separator vessel 6 are the same as used for the discharge oil separator vessel 4. The preferred size for the oil free discharge pipe 17, the dehydration tower-to-glycol separator pipe 18 and be dry gas discharge pipe 19 is 6" diameter. Discharge from the optional glycol separator vessel 6 is routed through the dry gas discharge pipe 19 to the common gas discharge pipe header 20. The common gas discharge pipe header 20 is flanged on each end for connection to added skids at the site. The common gas discharge pipe header 20 is oversized to handle the combined flows of several compressors installed at a facility. The pipe diameter may be adjusted for unanticipated site-specific needs. The preferred sizes for the common gas discharge pipe header 20 are 6" to 12" diameter.

The All-in-One skid assembly 1 design also includes the option to add a fuel gas treatment and metering system. Advantages of integrating the utility gas systems, fuel gas 92, starting gas 93, and instrument gas 94 into the skid design include increasing the stand-alone capabilities of the completed skid, reducing costs by eliminating long runs of piping systems for each system from centralized sources, shortened site construction time, and a smaller site footprint.

This disclosure describes a skid assembly with an "All-in-One" functionality, preferably it is designed to be prefabricated and shipped as an assembly, and it is specifically expandable on a "unit by unit" need basis, a concept which is lacking in previous systems. As each compressor is added at a site, one of the new skids can also be added. With each new skid all of the equipment needs for the added compressor are met. If a compressor needs to be removed and relocated from a site the companion All-in-One 1 skid can easily be removed and relocated with the compressor to provide all of the compressor needs at the future installation location. There is no guesswork for how big of a separate slug catcher system to install. There is no guesswork for how big the inlet filter separator 3, or the discharge oil separator 4, vessel(s) should be. Inlet piping sizes do not require any initial guesswork. The integral inlet separator 2 itself becomes the slug catcher and overall drain system. The preferred mechanical pressure design specification for all skid components is 600# Class ANSI flange rating. The preferred ASME Code design, fabrication and testing criteria is B31.8. The preferred construction material is carbon steel.

The foregoing description merely illustrates the invention is not intended to be limiting. It will be apparent to those skilled in the art that various modifications can be made without departing from the inventive concept. Accordingly, it is not intended that the invention be limited except by the appended claims:

The invention claimed is:

1. An All-in-One skid for use with an individual compressor, the skid comprising a plurality of functional equipment used to operate a petrochemical gas gathering compressor facility and providing a traveling pathway for fluid generated from a well to the individual compressor and from the individual compressor to a utility gas service, the fluid being comprised of gas and condensate the skid being comprised of:

a common gas inlet pipe header that receives the fluid generated from the well, a skid gas inlet pipe connecting the common gas inlet pipe header to an integral inlet separator, the integral inlet separator functioning to gravity separate out the gas from the condensate in the fluid generated from the well and accumulating a condensate level inside, wherein the condensate can be drained from the integral inlet separator via an integral inlet separator drain pipe; the integral inlet separator being sized for gravity separation and to process a flow as required by the individual compressor, and the integral inlet separator being fluidly connected to each one of the plurality functional equipment and to the individual compressor via at least one drain system;

wherein the plurality of functional equipment is comprised of pre-compressor functional equipment and post-compressor functional equipment; wherein one component of the pre-compressor functional equipment is an inlet filter separator vessel, the inlet filter separator vessel is comprised of a first stage and a second stage; the first stage being fluidly connected to the integral inlet separator via a pipe to inlet filter and a gravity drain pipe, the second stage being fluidly connected to the integral inlet separator via a low pressure drain pipe;

whereby the gas travels from the integral inlet separator up the pipe to inlet filter into the first stage of the inlet filter separator vessel; whereby the gas travels from the first stage of the inlet filter separator to the second stage of the inlet filter separator, whereby the gas travels out of the second stage of the inlet filer separator into a compressor inlet pipe through a compressor inlet suction control valve into the individual compressor;

the individual compressor transforming the gas that is separated out into compressor discharge gas, the compressor discharge gas then travels through each one of the plurality of post-compressor functional equipment and ultimately through a common gas discharge pipe header ending at the utility gas service, and wherein any condensate generated by each one of the plurality functional equipment and individual compressor ultimately drains back into to the integral inlet separator.

2. The skid of claim 1, whereby the condensate generated by the first stage of the inlet filter separator vessel travels down the gravity drain pipe into the integral inlet separator vessel;

whereby the condensate generated by the second stage of the inlet filter separator vessel travels down the low pressure drain pipe to a blowcase vessel through a level control automated diverter valve; the blowcase vessel and the level control automated diverter valve being fluidly connected to the inlet filter separator via a low pressure drain pipe and the blowcase vessel and the level control automated diverter valve being fluidly connected to the integral inlet separator via a blowcase pressurized drain pipe, whereby when the blowcase vessel is full of condensate, the blowcase level controller on the blowcase vessel will actuate the level control automated diverter valve to close off the diverter valve low pressure drain pipe connection and to open the diverter valve pressurized feed gas pipe connection allowing the compressor discharge gas at a high pressure originating from the individual compressor via a plurality of pipes emanating from a utility gas outlet connection on the common gas discharge pipe header, to blow the condensate from the blowcase vessel into the integral inlet separator via the blowcase pressurized drain pipe;

whereby when the blowcase vessel is empty, the blowcase level controller on the blowcase will actuate the automated diverter valve to close off the diverter valve pressurized feed gas pipe connection and open the diverter valve low pressure drain pipe connection; a small volume of the pressurized gas in the blowcase vessel is vented up the low pressure drain pipe into the second stage of the inlet filter separator vessel; whereby the small volume of pressured gas travels out of the second stage of the inlet filer separator into the compressor inlet pipe through the compressor inlet suction control valve into the individual compressor.

3. The skid of claim 1 wherein the compressor inlet pipe further comprises a pressure equalizing pipe comprised of a equalizing pipe inlet connection and a generic backflow preventer valve, the equalizing pipe inlet connection being located on the compressor inlet pipe downstream of the compressor inlet suction control valve and ending at an equalizing pipe outlet connection on the integral inlet separator; whereby when the individual compressor is stopped thereby trapping the compressor discharge gas is at a high pressure, the compressor discharge gas at the high pressure can automatically depressurize into the integral inlet separator via the pressure equalizing pipe and whereby the generic backflow preventer valve prevents back-flow from the integral inlet separator during normal compressor operation.

4. The skid of claim 1, further comprising an inlet slug catcher liquid PSO system having a mechanical float inside, the inlet slug catcher liquid PSO system is fluidly connected in between the skid gas inlet pipe and the integral inlet separator, the inlet slug catcher liquid PSO system connecting to the skid gas inlet pipe via a PSO inlet connection and the inlet slug catcher liquid PSO system connecting to the integral inlet separator via both a PSO upper discharge connection and a PSO lower discharge connection;

whereby a discharge of condensate from the integral inlet separator through the PSO lower discharge connection influences the mechanical float inside the liquid PSO device to rise and fall in coordination with the condensate level inside the integral inlet separator, whereby when the condensate level rises to a maximum design condensate level inside the integral inlet separator, the mechanical float will rise to plug the PSO inlet connection and therefore stop all flow to the integral inlet separator until the condensate level inside the integral inlet separator is lowered via the integral inlet separator drain pipe.

5. The skid of claim 1 wherein the common gas inlet pipe header and the common gas discharge pipe header are both flanged on each end allowing two or more skids to be connected in series.

6. The skid of claim 1, wherein one component of the post-compressor functional equipment is a discharge oil separator vessel, the discharge oil separator vessel receiving the compressor discharge gas from the individual compressor via a compressor discharge pipe, the discharge oil separator vessel comprising a first stage and a second stage, the first stage of the discharge oil separator vessel is fluidly connected to the integral inlet separator via the oil separator pressurized first stage drain, and the second stage of the discharge oil separator vessel is fluidly connected to the integral inlet separator via the oil separator pressurized second stage drain, whereby the condensate generated by the first stage of discharge oil separator vessel travels down the oil separator pressurized first stage drain into the integral inlet separator vessel; whereby the condensate generated by the second stage of discharge oil separator vessel travels down the oil separator pressurized second stage drain into the integral inlet separator vessel;

wherein the compressor discharge gas flows out of the discharge oil separator vessel through the second stage of the discharge oil separator vessel outlet to an oil free discharge pipe.

7. The skid of claim 6, wherein the oil separator pressurized first stage drain and the oil separator pressurized second stage drain are further comprised of globe-type pressure reducing valves to reduce pressure and flow of condensate traveling to the integral inlet separator.

8. The skid of claim 6, further comprising a dehydration contactor tower, the dehydration contactor tower being fluidly connected to the discharge oil separator vessel via the oil free discharge pipe and the dehydration contactor tower receiving the compressor discharge gas from the oil free discharge pipe, the dehydration contactor tower being fluidly connected to a glycol separator vessel, wherein the compressor discharge gas flows out of the dehydration contactor tower via a dehydration contactor tower-to-glycol separator pipe to the glycol separator vessel;

the glycol separator vessel comprising a first stage and a second stage, the first stage of the glycol separator is fluidly connected to the integral inlet separator via a glycol separator pressurized first stage drain, and the second stage of the glycol separator vessel is fluidly connected to the integral inlet separator via a glycol separator pressurized second stage drain, whereby the condensate generated by the first stage of glycol separator vessel travels down the glycol separator pressurized first stage drain into the integral inlet separator vessel; whereby the condensate generated by the second stage of glycol separator vessel travels down the glycol separator pressurized second stage drain into the integral inlet separator vessel;

whereby compressor discharge gas flows out of the second stage of glycol separator vessel to a dry gas discharge pipe, the dry gas discharge pipe being fluidly connected to the glycol separator vessel and being fluidly connected to a common gas discharge pipe header; the common discharge pipe header also being fluidly connected to the utility gas service.

9. The skid of claim 8, wherein the glycol separator pressurized first stage drain and the glycol separator pressurized second stage drain are further comprised of globe-type pressure reducing valves to reduce pressure and flow of the condensate traveling to the integral inlet separator.

10. The skid of claim 1, whereby the utility gas services is comprised of a utility gas outlet, a high pressure utility gas feed pipe, a utility systems filter, a first pressure cut regulator and a pressurized utility systems drain pipe; wherein the compressor discharge gas is fed from the common discharge pipe through the utility gas outlet connection into the high pressure utility gas feed pipe that is fluidly connected the utility systems filter via the first pressure cut regulator; the utility systems filter separates out any condensate generated by the first pressure cut regulator; the separated condensate is then drained from the utility systems filter back to the integral inlet separator through the pressurized utility systems drain pipe.

11. The skid of claim 10 further comprised of a fuel gas system, a starting gas system, and an instrument gas system.

12. The skid of claim 10, wherein the pressurized utility systems drain pipe is further comprised of a globe-type pressure reducing valve to reduce pressure and flow of the condensate draining back to the integral inlet separator.

13. The skid in claim 1, wherein the common gas inlet pipe header is further comprised of an inlet ESD (emergency shutdown) valve and a blowdown automated valve to be used for emergency isolation and skid de-gassing.

14. The skid of claim 1 wherein the condensate level inside the integral inlet separator is measured by a level gauge connected to the integral inlet separator at an upper level gauge connection and at a lower level gauge connection; the integral inlet separator drain pipe is fluidly connected to the integral inlet separator at a primary liquid drain connection and a secondary liquid drain connection; an automated drain valve located on the integral inlet separator drain pipe is controlled by an integral inlet separator level controller installed on the level gauge;

whereby when the condensate level rises up to the upper level gauge connection, the integral inlet separator level controller opens the automated drain valve allowing the condensate to drain and when the condensate level inside drains down to the lower gauge connection, the integral inlet separator level controller closes the automated drain valve.

15. An assembly comprising a plurality of pre-compressor systems and a plurality of post-compressor systems for use in a petrochemical gas gathering compressor facility; wherein the plurality of pre-compressor systems comprises an integral inlet separator and an inlet filter separator vessel; wherein the integral inlet separator is sized to gravity separate out gas from condensate; whereby the separated gas then travels directly to the inlet filter separator vessel; wherein the integral inlet separator is a common sump for any condensate generated by all the pre-compressor and post-compressor systems; the integral inlet separator being connected to all the pre-compressor and post-compressor systems to allow for either gravity drainage or low pressure drainage into the integral inlet separator; the assembly being a single skid platform for use with a single compressor of the petrochemical gas gathering compressor facility.

16. The assembly of claim 15 wherein the plurality of post-compressor systems comprises a discharge oil separator and a utility gas service.

17. The assembly of claim 15 wherein the plurality pre-compressor systems is further comprised of an inlet slug catcher liquid PSO system.

18. The assembly of claim 15 wherein the plurality pre-compressor systems is further comprised of a blowcase.

19. The assembly of claim 16 wherein the plurality of post-compressor systems is further comprised of a dehydration contact tower.

20. The assembly of claim 16 wherein the plurality of post-compressor systems is further comprised of a glycol separator vessel.

21. The assembly of claim 16 wherein the plurality of post-compressor systems is further comprised of a fuel gas system, a starting gas system, and an instrument gas system.

22. The assembly of claim 15, whereby the skid is capable of being connected in series to another skid.

* * * * *